United States Patent [19]

Bresson et al.

[11] Patent Number: 4,848,433

[45] Date of Patent: Jul. 18, 1989

[54] TWO-SPEED REDUCING MECHANISM FOR CONTROLLING CLOSURE DEVICES WITH ADJUSTABLE LUMINOSITY, OF THE TYPE SUCH AS BLINDS WITH ORIENTABLE SLATS AND THE LIKE

[75] Inventors: René Bresson, Mantoche; Jean-Pierre Cerutti, Gray, both of France

[73] Assignee: Societe Industrielle Du Metal Usine (SIMU), Arc-Les Gray, France

[21] Appl. No.: 180,888

[22] Filed: Apr. 13, 1988

[30] Foreign Application Priority Data

Apr. 24, 1987 [FR] France ..... 87 06049

[51] Int. Cl.[4] ..... E06B 9/38

[52] U.S. Cl. ..... 160/178.1; 74/785

[58] Field of Search ..... 160/178.1; 74/785

[56] References Cited

U.S. PATENT DOCUMENTS 4,178,814 12/1979 Ahlen ..... 74/781 R 4,657,060 4/1987 Kaucic ..... 160/100

*Primary Examiner*—Blair M. Johnson

*Attorney, Agent, or Firm*—Dowell & Dowell

[57] ABSTRACT

A two-speed reducing mechanism for controlling the adjustment of a closure such as a blind having adjustable slats which includes a drive input shaft or wheel which is meshed with a planetary ger system supported by an output drive ring which itself is oriented within a rotatable bushing which may be selectively secured from rotation by a braking device. The planetary gear assembly is also meshed with the bushing so that when the bushing is rotatable, the closure member may be quickly adjusted in a one-to-one drive relationship with respect to the input shaft, however, when the bushing is prevented from rotating, the elements of the planetary gear assembly will rotate upon themselves causing a speed reduction.

2 Claims, 3 Drawing Sheets

TWO-SPEED REDUCING MECHANISM FOR CONTROLLING CLOSURE DEVICES WITH ADJUSTABLE LUMINOSITY, OF THE TYPE SUCH AS BLINDS WITH ORIENTABLE SLATS AND THE LIKE

BACKGROUND OF THE INVENTION

1. Field of the Invention

The present invention relates to closure devices in which the drive member is operable to adjust the positioning of closures such as blinds or shutters so as to alter the amount of light passing therethrough. It is particularly suitable for manoeuvring shutters with orientable slats or with perforated slats, vertically moving Venetian blinds, and curtains with vertical slats and with orientable displacement.

2. History of the Related Art

It is known that, in devices of the type discussed above that the rotation of the drum which, by winding the flexible ties which connect the orientable slats forming the apron to one another, ensures opening or closure thereof, and the selective orientation of the slats. Such adjustment being made in two opposite directions as a function of the direction of displacement (opening or closure). Under these conditions, it will be understood that, when the slats have been brought to the desired position it suffices to rotate for a very short period of time, a drive member in one direction or in the other depending on the desired orientation.

When the blind drive member is constituted by a crank manuvoured by hand, it is relatively easy to adjust the orientation. This is not the case when the drum is driven in rotation by means of an electric gear motor, since the speed considerably hinders the control. In fact, if a sufficiently high drive speed is chosen in order to ensure under acceptable conditions a rapid displacement of the slats, it becomes virtually impossible to adjust orientation thereof precisely, adjustment is intended to reduce the speed of rotation of the driving drum, it becomes difficult to tolerate the slow adjustment.

A compromise in adjustment speed has therefore had to be adopted which in fact does not satisfy either one or the other of the two speeds of adjustment.

SUMMARY OF THE INVENTION

It is an object of the present invention to overcome the aforementioned drawback by providing the closure devices of the type in question with a reducing mechanism adapted to give the winding drum, entirely automatically, two different speeds to correspond to the adjustments intended for the displacement of the apron or blind and for the precise adjustment of the filtering of the light.

The mechanism according to the invention, interposed between the output member of the drive system and the apron or blind winding drum is essentially noteworthy in that it comprises an input planet wheel which cooperates with at least one satellite wheel borne carried by an output ring and cooperating with a ring gear or bushing which is rotatably locked with the aid of a braking device actuated by the ring whenever the planetary wheel is set in rotation.

It will be readily appreciated that, depending on whether or not the outer ring is locked from rotating, the satellite wheel behaves either as a member of revolution introducing a gear down ratio in the drive of the ring, or as a member which does not exhibit any movement of rotation along its axis and which consequently transmits rotational movement in the ratio 1/1.

According to a preferred embodiment of the invention, the braking device comprises at least one spring of which the turns are disposed between a fixed friction wall and a cylindrical bearing surface of a ring gear, while its ends, bent inside this ring, cooperate with a radial finger or flange associated with the output ring.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
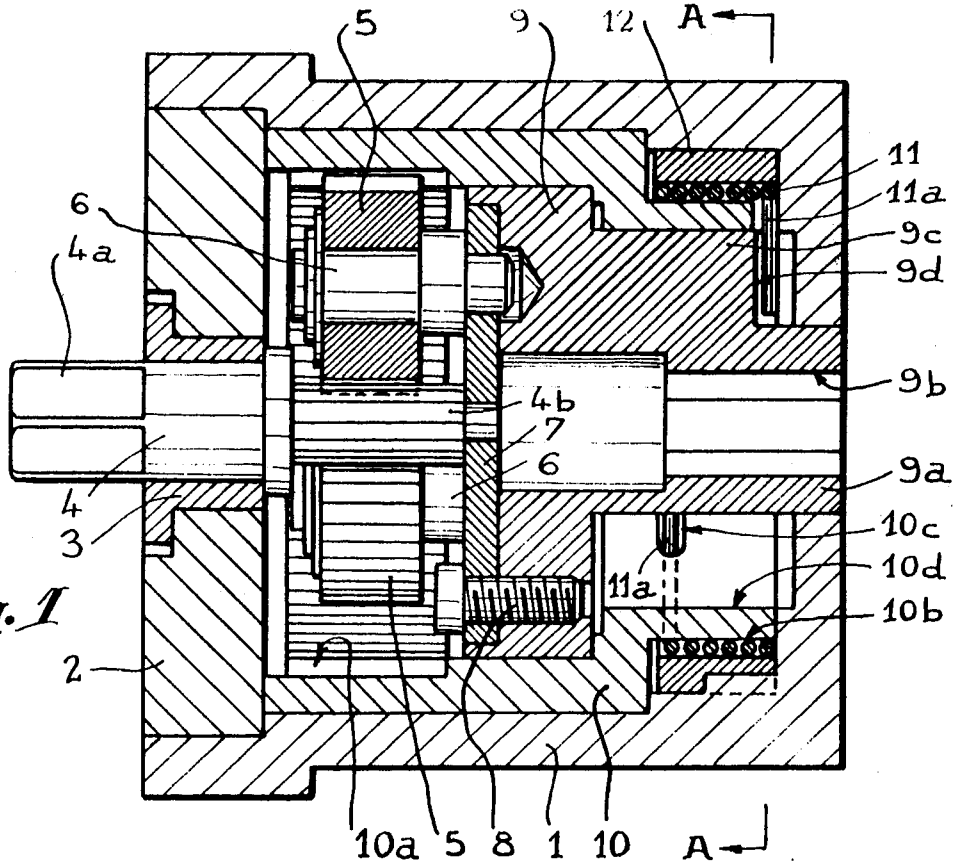
FIG. 1 is an axial section through a reducing mechanism according to the invention, assumed to be associated with a blind with vertical displacement and with orientable horizontal slats.

Referring now to the drawings, the speed reducing mechanism is mounted inside a casing formed by assembling a cylindrical box 1 closed by a transverse end wall 2. At its centre, end wall 2 is provided with a bearing 3 which supports a shaft 4 of which one end is sectioned at **4*a*** to be driven by the output member of a gear motor (not shown) intended for rotating the drum for winding the blind.

Inside this casing 1-2, the shaft 4 forming the drive input member for the mechanism, comprises a toothed part or shaft **4*b* which cooperates, in the manner of a planetary wheel, with satellite wheels 5, which are three in number in the embodiment disclosed. Each satellite wheel 5 rotates freely on a spindle 6 which is mounted so as to extend from a plate 7 that screws 8 secures against the front face of an output ring 9**.

The ring 9 is engaged with reduced clearance inside the axial opening of a rotating bushing 10 itself centred in the casing 1-2. The wall of the the opening of the bushing 10 presents, in front of the ring 9, teeth **10*a* which mesh with the satellite wheels 5, the bushing 10** thus being assimilable to a ring gear.

Figure 2:
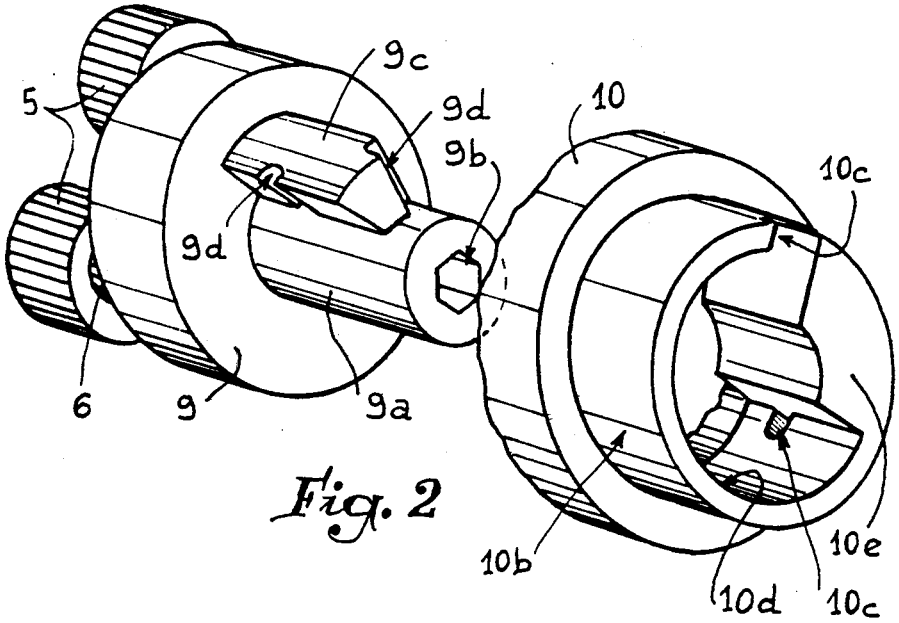
FIG. 2 shows in perspective, prior to being assembled in the casing of the device, the output ring equipped with its satellite wheels and the ring gear.

The mechanism is provided with a braking system which comprises a spring 11 whose turns are disposed between a rear cylindrical bearing surface **10*b* of the bushing or ring 10 and an annular friction lining 12 glued or otherwise secured against the inner wall of the casing 1-2. Furthermore, and as shown more particularly in FIG. 2, the rear part of the ring 9 comprises, in addition to an axial hub 9*a* open at 9*b* to ensure drive of the conventional hexagonal-section endpiece of blind drums, a radial tooth or flange 9*c* of which the longitudinal faces have notches 9*d* cut therein. These notches 9*d* are adapted to receive the bent ends 11*a* of the spring 11, which ends penetrate via notches 10*c* inside a chamber 10*d* made in the rear bearing surface 10*b* of the bushing 10. The chamber 10*d* presents a semi-circular section which consequently defines a sector-shaped projection 10*e***.

It will be readily understood that, when the bushing or ring 10 is free to rotate in the casing 1-2 while the shaft 4 is driven in rotation by the gear motor, the wheels 5 turn without rolling on themselves, behaving like simple connecting members and therefore driving the bushing at the same time as the ring 9. The transmission ratio is then 1/1.

On the contrary, if it is now assumed that the bushing 10 is secured from rotation, the wheels 5 will, while still being rotated, rotate on themselves due to the fixed teeth 10*a*, thereby introducing a gear down ratio in the connection with ring 9.

The diameter of the wire which forms the spring 11 is such that, in rest position, i.e. when the spring is not subjected to any effort, it bears simultaneously against a lining 12 and against the bearing surface 10*b* of the bushing 10, with the result that the bushing is prevented from rotating.

Figure 3:
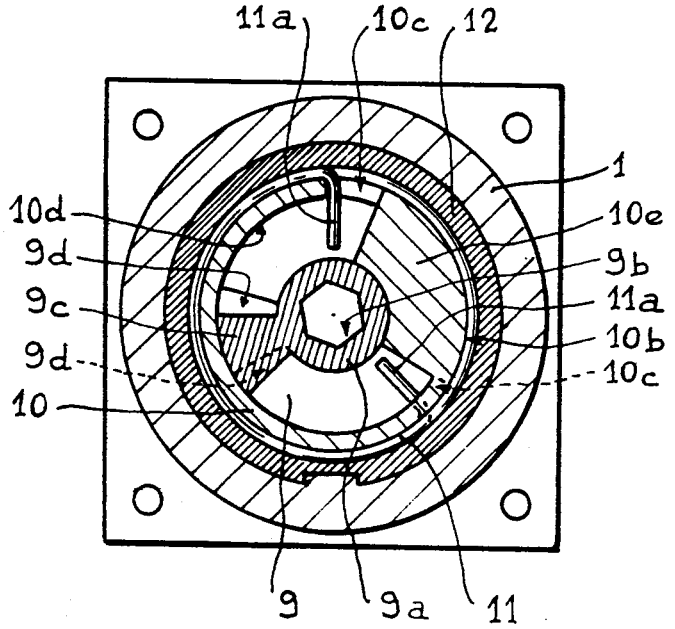
FIGS. 3 to 5 are schematic sections along the transverse plane A—A of FIG. 1 illustrating the operation of the adjustment mechanism in three different phases.

Under these conditions, when the gear motor associated with shaft 4 is switched on, the output ring 9 is driven with a considerable reduction. It is the position illustrated in FIG. 3 which clearly shows that the flange 9*c* can move in chamber 10*d* with an amplitude of about 180° before coming into abutment against one or the other of the bent ends 11*a* of the spring 11.

Figure 4:
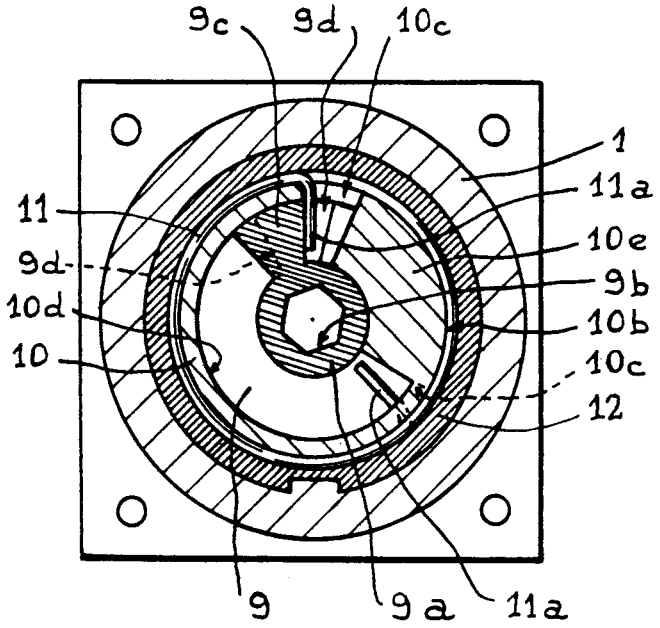
Figure 5:
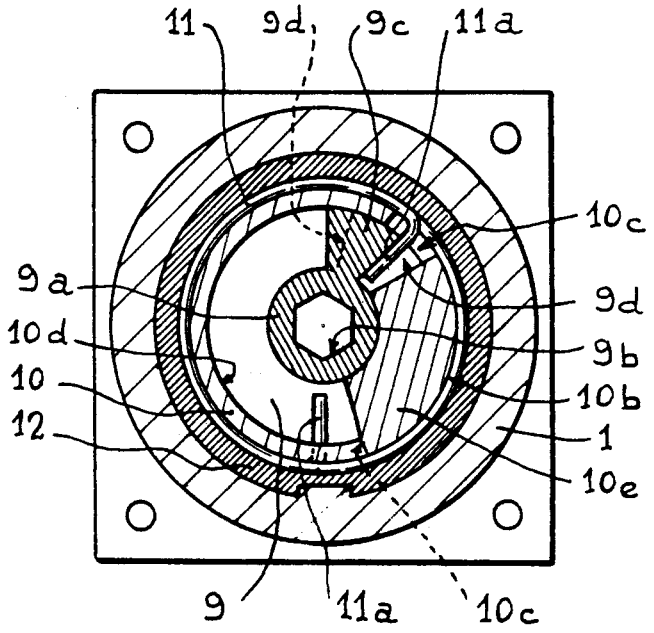

At a given instant of its rotation (FIG. 4), the flange 9*c* comes into abutment against an end 11*a* which engages in the notch 9*b* which is there-opposite. Before abutting against the lateral face of the projection or sector 10*e*, the finger 9*c* pushes the end 11*a*, which has for its effect to tighten the spring 11 radially inwardly thereby compressing the spring against bearing surface 10*b*, and thereby releasing the bushing or ring 10 from the brake lining 12. The bushing 10 is consequently driven in rotation by the flange 9*c* (cf. FIG. 5), so that the reduction stops immediately and the drum of the blind, driven at high speed, may ensure rapid winding or unwinding of the ties associated with the slats.

Once the blind is stopped at the desired height, the user may again control the gear motor in one direction or the other in order to adjust the orientation of the slats. The satellite wheels 5 intervene further to stop the rotation of the bushing 10, with the result that the drum is driven at much reduced geared-down speed, thus allowing a perfectly precise adjustment.

It goes without saying that other systems for braking the bushing 10 may be imagined, despite the simplicity and reliability of the device which has been set forth hereinabove. In particular, it may be advantageous to provide two springs 11 with opposite directions of winding, mounted side by side on the bearing surface 10*b* and of which the bent outer ends 11*a* pass radially therethrough to cooperate selectively with the flange 9*c* of the ring 9, while the central ends are secured with the sector 10*e*.

It must, moreover, be understood that the foregoing description has been given only by way of example and that it in no way limits the domain of the invention which would not be exceeded by replacing the details of execution described by any other equivalents. In particular, the reducing mechanism according to the invention may equally well be made as an accessory apparatus adapted to be interposed between a conventional closure device and its driving gear motor, and as an assembly adapted to be directly incorporated in a device especially designed to that end.

What is claimed is:

1. A speed reducing mechanism for controlling closure devices such as shades and blinds which are adjusted utilizing a drive member comprising a casing having opposite ends, an input drive shaft extending through one end of said casing and having a first end which is drivingly connected to the drive member and a toothed end portion within said casing, a ring gear mounted within said casing adjacent said tooth end portion of said input drive shaft and having a drive output, a fixed flange extending outwardly of said ring gear, at least one toothed satellite wheel carried by said ring gear, said satellite wheel being rotatably meshed with said toothed end portion of said input drive shaft, a rotatable bushing having a first bearing surface end portion which encircles a portion of said ring gear and a second end portion which encircles said satellite wheel, said second end portion of said bushing including teeth which are meshed with said satellite wheel, a fixed friction lining mounted within said casing adjacent said first portion of said bushing, at least one spring having coils which extend around said first bearing surface end portion of said bushing and having ends which extend inwardly toward said ring gear so as to be selectively engageable with said flange, said coils of said at least one spring engaging said friction surface to thereby act as a brake to prevent rotation of said bushing so that said ring gear is rotated at a reduced speed relative to said input drive shaft and said ends of said at least one spring being engageable by said flange of said ring gear so that said coils are caused to be compressed thereby withdrawing said coils from said friction lining whereby said bushing is free to rotate with said input drive shaft so that said ring gear is driven at a one-to-one relationship with said input drive shaft.

2. The speed reducing mechanism of claim 1 wherein said flange includes notches cut in opposite sides thereof in which said ends of said spring may be cooperatively seated, said bushing including an inwardly directed projection having opposite side walls, said flange being engageable with said side walls so as to rotate said bushing with said ring gear.

* * * * *